US006002093A

United States Patent [19]

Hrehor, Jr. et al.

[11] Patent Number: 6,002,093

[45] Date of Patent: Dec. 14, 1999

[54] BUTTON WITH FLEXIBLE CANTILEVER

[75] Inventors: Robert D. Hrehor, Jr.; James D. Curlee, both of Round Rock, Tex.

[73] Assignee: Dell USA, L.P., Round Rock, Tex.

[21] Appl. No.: 09/137,730

[22] Filed: Aug. 21, 1998

[51] Int. Cl.[6] ..... H01H 13/52

[52] U.S. Cl. ..... 200/345; 200/520; 200/343

[58] Field of Search ..... 200/5 A, 512, 200/517, 520, 534, 535, 341, 511, 343–345; 400/472, 490, 491.2, 495, 495.1, 496

[56] References Cited

U.S. PATENT DOCUMENTS

| | | | |
|---|---|---|---|
| 3,665,378 | 5/1972 | Hammell et al. | 339/217 S |
| 3,673,357 | 6/1972 | Molchan | 200/5 A |
| 3,999,025 | 12/1976 | Sims, Jr. | 200/159 B |
| 4,127,752 | 11/1978 | Lowthorp | 200/5 A |
| 4,249,053 | 2/1981 | Tsutsui | 200/153 J |
| 4,373,683 | 2/1983 | Kyker | 242/84.21 R |
| 4,638,151 | 1/1987 | Suwa | 235/145 R |
| 4,689,455 | 8/1987 | Watanabe | 200/340 |
| 5,362,932 | 11/1994 | Inagaki et al. | 200/341 |
| 5,694,124 | 12/1997 | Wood | 341/22 |
| 5,788,060 | 8/1998 | Kuroda | 200/343 |

*Primary Examiner*—Michael Friedhofer
*Attorney, Agent, or Firm*—Skjerven, Morrill, MacPherson, Franklin & Friel, L.L.P.; Marc R. Ascolese

[57] ABSTRACT

A button with at least one flexible cantilever and an actuating portion coupled to the button can either be integrally formed from a single piece of material or assembled into a single device so that the button can be easily and quickly installed into a button housing. Additionally, because of the simplified one-piece design of the button, the button housing is further simplified.

15 Claims, 3 Drawing Sheets

BUTTON WITH FLEXIBLE CANTILEVER

BACKGROUND OF THE INVENTION

1. Field of the Invention

This invention relates to buttons for actuating switches.

2. Description of the Related Art

Many computer systems, including personal computers, workstations, servers, and embedded systems are designed to have multiple peripheral devices included in the system. A typical personal computer system includes a processor, associated memory and control logic and a number of peripheral devices that provide input and output (I/O) for the system. Such peripheral devices include, for example, compact disk read-only memory (CD-ROM) drives, hard disk drives, floppy disk drives, and other mass storage devices such as tape drives, compact disk recordable (CD-R) drives or digital video/versatile disk (DVD) drives. Additionally, computer systems often have the capability to interface with external enclosures that include additional peripheral devices.

The computer systems, their included peripheral devices, associated external enclosures, and many other electronic devices typically have one or more external buttons providing user control of one or more functions of the device, e.g a power button. Often, the button is not itself a switch, but rather an actuator that when pushed activates a switch internal to the device, e.g. a momentary on/off switch attached to the power circuit of a computer system. A common design for such button assemblies is shown in the cross-sectional drawings of FIGS. 1A and 1B. Button 100 includes tabs 102 and center post 104. Compression spring 120 has an inner diameter large enough to accommodate center post 104. Once inserted into button housing 130, tabs 102 of button 100 engage the rear portions 132 of the button housing. Button housing 130 is typically formed as part of a chassis, enclosure, or front bezel for a computer system or other device. Center post 104 is free to move within hole 136, and spring 120 is compressed between button 100 and spring supports 134. When installed, button 100, spring 120, and button housing 130 combine to form button assembly 140 as illustrated in FIG. 1B. When pushed in the direction of arrow 150, spring 120 compresses, and button 100 can actuate a switch (not shown) with center post 104, or some other actuating portion. When button 100 is released, spring 120 forces the button in a direction opposite to that of arrow 150, until the buttons motion is constrained by tabs 102 engaging button housing rear portions 132.

The button assembly of FIGS. 1A and 1B requires at least two parts, button 100 and spring 120. Increasing the number of parts both increases the cost of the button assembly, and complicates construction of button assembly 140. Additionally, the prior art design including spring 120 uses a complicated button housing molded into the bezel or enclosure. Accordingly, it is desirable to have a single piece button that can easily be installed into a simplified bezel or enclosure.

SUMMARY OF THE INVENTION

It has been discovered that a button including at least one flexible cantilever and an actuating portion can either be integrally formed from a single piece of material or assembled into a single device so that the button can be easily and quickly installed into a button housing. Additionally, because of the simplified one-piece design of the button, the button housing is further simplified.

Accordingly, one aspect of the present invention provides an apparatus for activating a switch including a button having an exterior side, a first flexible cantilever coupled to the button for biasing the button away from the switch, and an actuating portion coupled to the button, the actuating portion located on the button so as to activate the switch when the button is pressed on the exterior side.

In another aspect of the invention, a computer system includes a processor; a memory coupled to the processor; a switch coupled to the processor; a chassis supporting the processor, memory, and switch; and a button assembly coupled to the chassis. The button assembly includes a button having an exterior side. A first and a second flexible cantilever are coupled to the button for biasing the button away from the switch. An actuating portion is coupled to the button and is located on the button so as to activate the switch when the button is pressed on the exterior side. The button assembly also includes a button housing having a base, a first retention clip, and a second retention clip. The base includes a first side, an opposing second side, and an aperture extending between the first side and the second side. The first and second retention clips are coupled to the second side of the base and secure the first and second flexible cantilevers, respectively, such that at least a portion of the button is slidably received in the aperture.

In still another aspect of the invention, a method of installing a button into a button housing includes providing a button having an exterior side, a first flexible cantilever and an actuating portion. A button housing is also provided and includes a base having a first side, an opposing second side, and an aperture extending between the first side and the second side; and a first retention clip coupled to the second side of the base. A portion of the button is inserted into the aperture of the base such that the first flexible cantilever is engageable by the first retention clip. The button is rotated until the first flexible cantilever is engaged by the first retention clip.

In yet another aspect of the invention, a method of installing a button into a button housing includes providing a button having an exterior side, a first flexible cantilever and an actuating portion. A button housing is also provided and includes a base having a first side, an opposing second side, and an aperture extending between the first side and the second side; and a first retention clip coupled to the second side of the base and including a retention aperture. A free end of the first flexible cantilever is inserted into the retention aperture of the first retention clip. The first flexible cantilever is flexed. A portion of the button is inserted into the aperture of the base.

BRIEF DESCRIPTION OF THE DRAWINGS

The present invention may be better understood, and its numerous objects, features, and advantages made apparent to those skilled in the art by referencing the accompanying drawings.

DETAILED DESCRIPTION

Figure 1B:
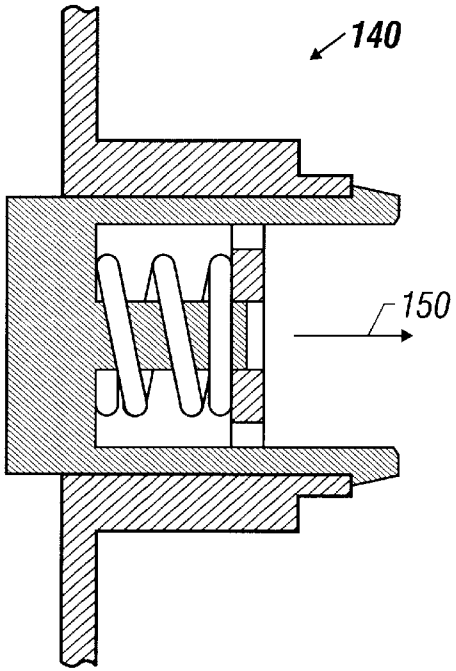
FIG. 1B (Prior Art)
FIGS. 1A and 1B, labeled prior art, illustrate the cross-section of a prior art button assembly.
Figure 1A:
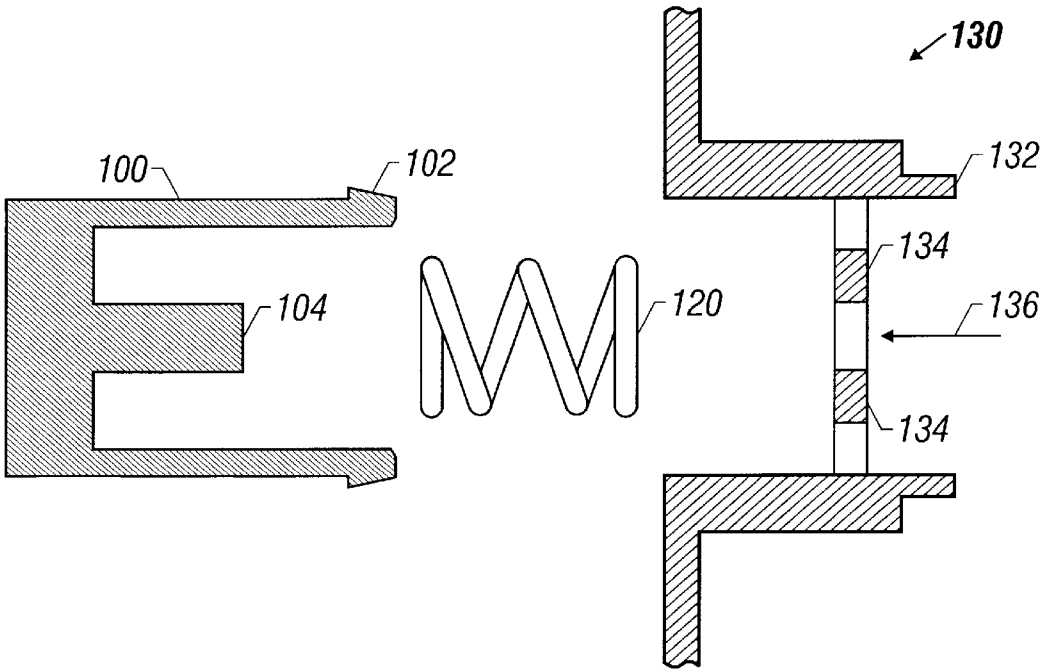
FIG. 1A (Prior Art)
Figure 2B:
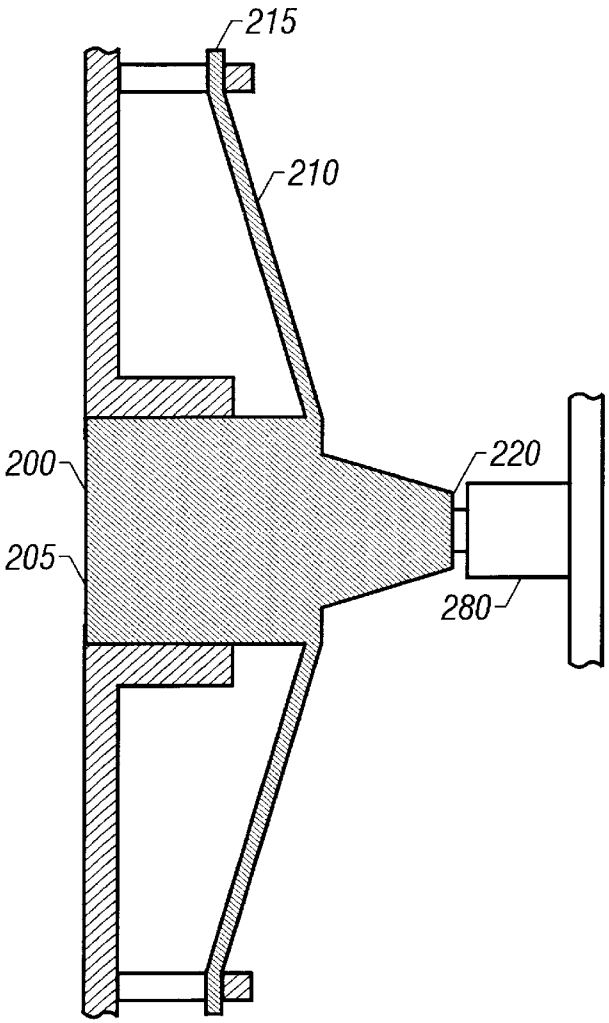
FIGS. 2A and 2B illustrate a diagrammatic cross-sectional view of a button with flexible cantilevers installed in a button housing.
Figure 2A:
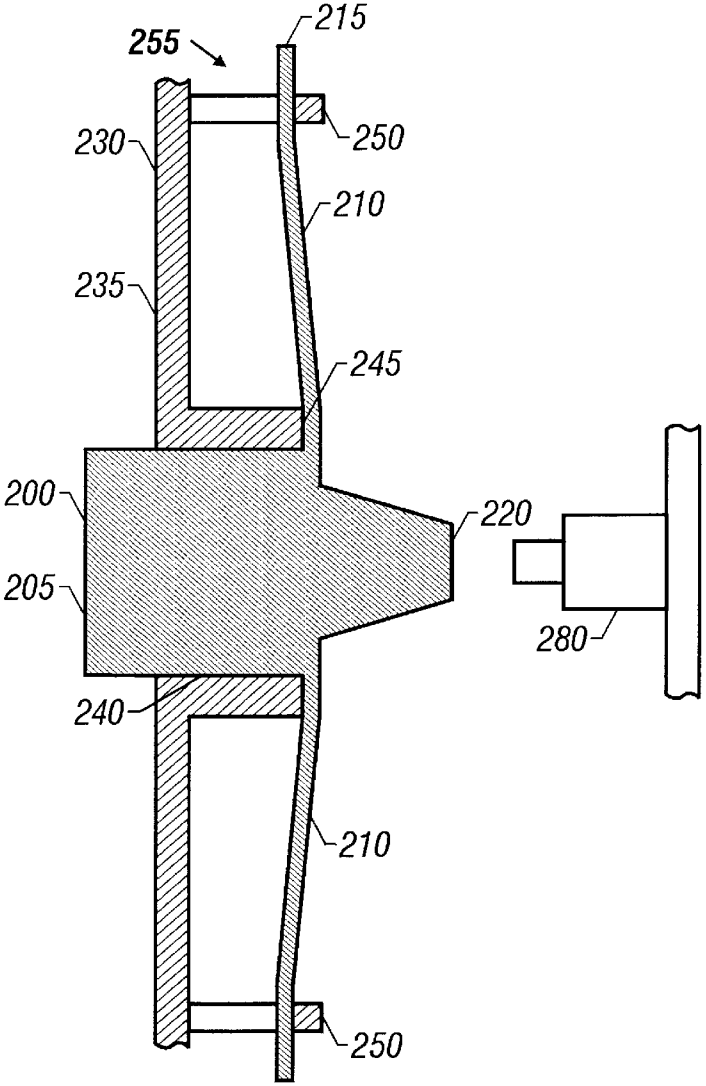

FIG. 2A illustrates a cross-sectional view of a button 200 having integrally formed flexible cantilevers 210 and an actuating portion 220. Button 200 is mounted to button housing 230 so that a portion of the button is slidably received in an aperture 240 of button housing 230. Although button 200 is shown press fit into aperture 240, it should generally be understood that there is sufficient room between button 200 and the walls of aperture 240 so that the button may move in directions toward and away from switch 280. Switch 280 is, for example, a power switch or system reset switch for a computer system. On one side of base 235 of housing 230, retention clips 250 are located so that they can retain the flexible cantilevers 210. In the example illustrated, retention clips 250 each include a retention aperture 255 through which free ends 215 of flexible cantilevers 210 are inserted. Retention clips 215 bias flexible cantilevers 210, and in turn button 200, in a direction away from switch 280. Additionally, rear portion 245 of button housing 230 provides a lip against which the flexible cantilevers are held when free ends 215 are retained by retention clips 250.

When pressure is applied to surface 205 of button 200, as shown in FIG. 2B, flexible cantilevers 210 flex and/or stretch allowing actuating portion 220 to make contact with switch 280. A comparison of FIGS. 2A and 2B shows that the free ends 215 of flexible cantilevers 210 extend far enough through retention apertures 255 so that when button 200 is pressed, the cantilevers remain retained by the retention clips.

Because flexible cantilevers 210 and actuating portion 220 are coupled to button 200 (either as an integrally formed single piece or as a single piece assembled from several separate pieces) installing the button into the button housing is simplified, as are the button housing features used to retain and support the button. For example, the button of FIGS. 2A and 2B, can be installed in button housing 230 by flexing both cantilevers (e.g. pinching them toward each other) so that they clear retention clips 250, inserting the button into aperture 240, and releasing the cantilevers so that they extend through retention apertures 255 and are thereby retained by retaining clips 250. Alternatively, one flexible cantilever can be inserted into a retention aperture and subsequently flexed so that button 200 can be inserted into aperture 240. Then, the second flexible cantilever can be flexed and inserted into the other retention clip.

Figure 3:
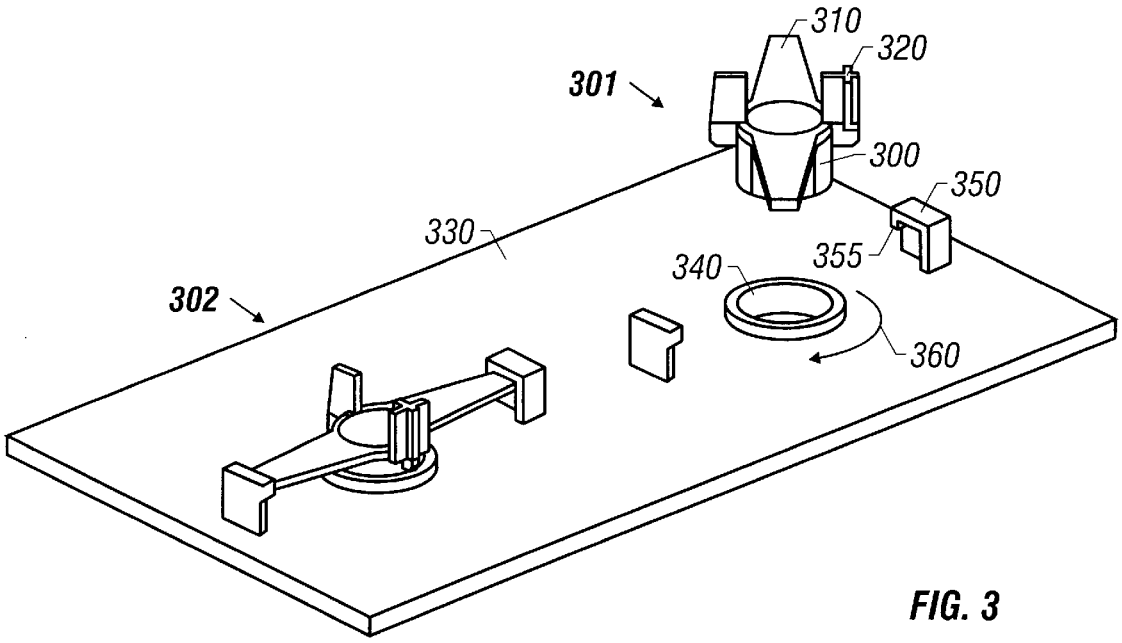
FIG. 3 illustrates a second button with flexible cantilevers and how it is installed in a button housing.

FIG. 3 illustrates another example of a button with flexible cantilevers. Label 301 shows button 300 prior to installation in button housing 330. Coupled to button 300 are flexible cantilevers 310 and actuating portion 320. After a portion of button 300 is inserted into aperture 340 of button housing 330, the button is rotated in the direction of arrow 360 until flexible cantilevers 310 are captured by retention clips 350 which each include a locking tab 355. The installed button with flexible cantilevers is shown at 302.

Figure 4:
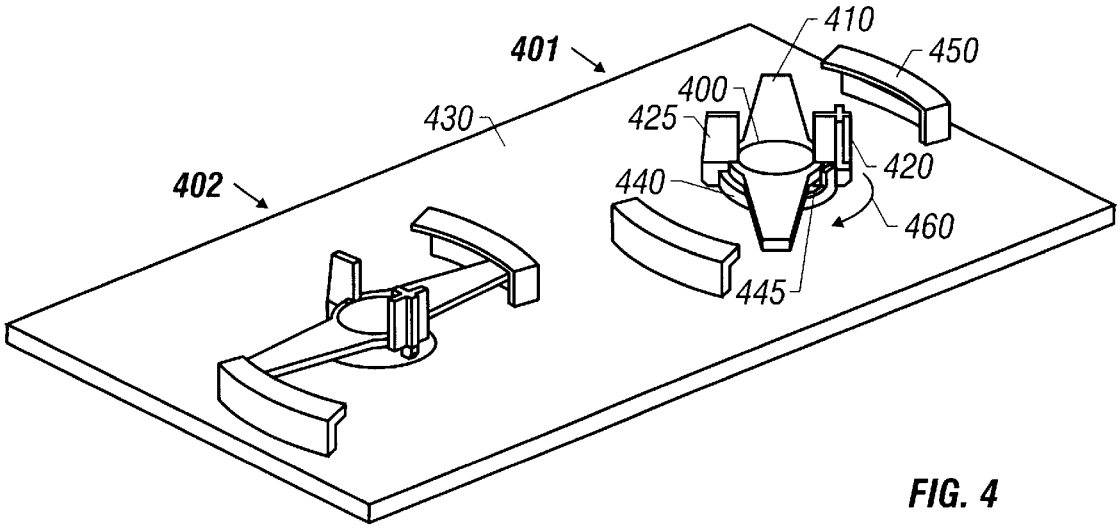
FIG. 4 illustrates a third button with flexible cantilevers and how it is installed in a button housing.

FIG. 4 illustrates still another example of a button with flexible cantilevers. Label 401 shows button 400 during installation in button housing 430. Coupled to button 400 are flexible cantilevers 410 and actuating portion 420. After a portion of button 400 is inserted into the aperture (surrounded by collar 440) of button housing 430, the button is rotated in the direction of arrow 460 until flexible cantilevers 410 are captured by retention clips 450 and actuating portion 420 comes to rest in slot 445 of collar 440. Additionally, second button portion 425 can come to rest in another slot (not shown) in collar 440. In this example, retention clips 450 are wider than retention clips 350 and do not include any additional securing features such as locking tab 355. The installed button with flexible cantilevers is shown at 402. Those having ordinary skill in the art will readily recognize that a variety of different retention clip designs can be used to retain the flexible cantilevers described.

As noted above, the button, flexible cantilevers, and actuating portion can be integrally formed from a single piece of a material (e.g. injection molded) or assembled into a single piece from several separate parts. A variety of different materials can be used to construct both the button and the button housing including metals and plastics such as thermoplastics (e.g. polycarbonate, and ABS). Additionally, since the flexible cantilevers act much like leaf springs, leaf springs can be used in their place. Although the examples presented in FIGS. 2A, 2B, 3, and 4 all employ two flexible cantilevers, alternative designs can utilize only one flexible cantilever, or more than two. Depending upon the application, the button housing can be formed as part of an enclosure for a computer system or other device, a bezel or cover for a computer system or other device, or a chassis for a computer system or other device. The button can include many additional features such special textures or shapes, markings or icons, and a hole or light pipe for transmitting light from one side of the button to another. Moreover, the actuating portion can be adapted to operate many different types of switches.

The description of the invention set forth herein is illustrative and is not intended to limit the scope of the invention as set forth in the following claims. Variations and modifications of the embodiments disclosed herein may be made based on the description set forth herein, without departing from the scope and spirit of the invention as set forth in the following claims.

What is claimed is:

1. An apparatus for activating a switch comprising:

a button having an exterior side;

a first flexible cantilever coupled to the button for biasing the button away from the switch, the first flexible cantilever including a first surface and having a length;

an actuating portion coupled to the button, the actuating portion located on the button so as to activate the switch when the button is pressed on the exterior side; and a button housing including:

a base having a first side, an opposing second side, and an aperture extending between the first side and the second side; and a first retention clip coupled to the second side of the base, the first retention clip partially contacting the first surface of the first flexible cantilever to simultaneously limit motion of the button toward the switch when the button is pressed on the exterior side and allow the first flexible cantilever to move with respect to the first retention clip in a direction substantially parallel to the length of the first flexible cantilever.

2. The apparatus of claim 1 wherein the button, the first cantilever, and the actuating portion are integrally formed from a single piece of a material.

3. The apparatus of claim 2 wherein the material is a plastic.

4. The apparatus of claim 1 further comprising:

a second flexible cantilever coupled to the button, the second flexible cantilever including a first surface and having a length; and a second retention clip coupled to the second side of the base, the second retention clip partially contacting the first surface of the second flexible cantilever to simultaneously limit motion of the button toward the switch when the button is pressed on the exterior side and allow the second flexible cantilever to move with respect to the second retention clip in a direction substantially parallel to the length of the second flexible cantilever.

5. The apparatus of claim 1 wherein the first retention clip includes a retention aperture through which a free end of the first cantilever is inserted.

6. The apparatus of claim 1 wherein the base is one of a bezel for a computer system enclosure, a portion of a chassis, and a portion of an enclosure.

7. The apparatus of claim 1 wherein the base includes a slot located to receive the actuating portion.

8. The apparatus of claim 1 wherein the flexible cantilever is a leaf spring.

9. A computer system comprising:

a processor;

a memory coupled to the processor;

a switch coupled to the processor;

a chassis supporting the processor, the memory, and the switch; and a button assembly coupled to the chassis, the button assembly including:

a button having an exterior side;

a first and a second flexible cantilever coupled to the button for biasing the button away from the switch, the first and the second flexible cantilevers each including a first surface and each having a length;

an actuating portion coupled to the button, the actuating portion located on the button so as to activate the switch when the button is pressed on the exterior side; and a button housing including:

a base having a first side, an opposing second side, and an aperture extending between the first side and the second side;

a first retention clip coupled to the second side of the base, the first retention clip partially contacting the first surface of the first flexible cantilever to simultaneously limit motion of the button toward the switch when the button is pressed on the exterior side and allow the first flexible cantilever to move with respect to the first retention clip in a direction substantially parallel to the length of the first flexible cantilever; and a second retention clip coupled to the second side of the base, the second retention clip partially contacting the first surface of the second flexible cantilever to simultaneously limit motion of the button toward the switch when the button is pressed on the exterior side and allow the second flexible cantilever to move with respect to the second retention clip in a direction substantially parallel to the length of the second flexible cantilever.

10. The computer system of claim 9 wherein the button, the first and second cantilevers, and the actuating portion are integrally formed from a single piece of a material.

11. The computer system of claim 10 wherein the material is a plastic.

12. The computer system of claim 9 wherein the first retention clip includes a retention aperture through which a free end of the first cantilever is inserted.

13. The computer system of claim 9 wherein the base is a bezel coupled to the chassis.

14. A method of installing a button into a button housing comprising:

providing a button including an exterior side, a first flexible cantilever and an actuating portion;

providing a button housing including:

a base having a first side, an opposing second side, and an aperture extending between the first side and the second side; and a first retention clip coupled to the second side of the base;

inserting a portion of the button into the aperture of the base such that the first flexible cantilever is engageable by the first retention clip; and rotating the button until the first flexible cantilever is engaged by the first retention clip.

15. The method of claim 14 wherein the button includes a second flexible cantilever coupled to the button and the button housing includes a second retention clip coupled to the second side of the base, the method further comprising:

rotating the button until the second flexible cantilever is engaged by the second retention clip.

* * * * *